US009925805B2

(12) United States Patent
Kida

(10) Patent No.: US 9,925,805 B2
(45) Date of Patent: Mar. 27, 2018

(54) IMAGE FORMING APPARATUS AND CREATION METHOD OF PRINTED PRODUCT

(71) Applicant: CANON KABUSHIKI KAISHA, Tokyo (JP)

(72) Inventor: Akira Kida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/941,280

(22) Filed: Nov. 13, 2015

(65) Prior Publication Data

US 2016/0159116 A1 Jun. 9, 2016

(30) Foreign Application Priority Data

Dec. 9, 2014 (JP) ..... 2014-249375

(51) Int. Cl.

| | |
|---|---|
| ***B41J 29/38*** | (2006.01) |
| ***B41J 11/66*** | (2006.01) |
| ***B26D 5/08*** | (2006.01) |
| ***B26D 5/00*** | (2006.01) |

(52) U.S. Cl.
CPC ..... *B41J 11/663* (2013.01); *B26D 5/007* (2013.01); *B26D 5/08* (2013.01)

(58) Field of Classification Search
CPC ..... B41J 11/70; B41J 11/0065; B41J 11/663; B41J 11/42; B41J 29/38; B41J 29/393; B41J 11/66; B26D 5/08
USPC ..... 347/16, 19, 101, 104
See application file for complete search history.

(56) References Cited

U.S. PATENT DOCUMENTS

2012/0033006 A1* 2/2012 Murayama ..... B41J 2/2135 347/14
2013/0101329 A1* 4/2013 Kanazawa ..... B41J 11/70 400/621

FOREIGN PATENT DOCUMENTS

JP 2002-308517 A 10/2002
JP 2003-25667 A 1/2003

* cited by examiner

*Primary Examiner* — Jannelle M Lebron
(74) *Attorney, Agent, or Firm* — Canon U.S.A., Inc. IP Division

(57) ABSTRACT

An image forming apparatus includes an image forming unit to sequentially form images of an image group on a continuous sheet while providing a non-printing region between the images, a cutting unit to cut the continuous sheet, a discharge unit to which printed products on which an image is formed by the image forming unit and cut and created by the cutting unit, is discharged, and a control unit to control cutting of the continuous sheet at a leading end and a trailing end of a region in which an image is formed, to control cutting of the continuous sheet while having the non-printing region of a predetermined size at a leading end or a trailing end of a region in which a first or a last image of the image group is formed, and to control discharge of the created printed product to the discharge unit.

16 Claims, 9 Drawing Sheets

IMAGE FORMING APPARATUS AND CREATION METHOD OF PRINTED PRODUCT

BACKGROUND OF THE INVENTION

Field of the Invention

The present invention relates to an image forming apparatus that forms images on a continuous sheet and cuts the continuous sheet at each of the images to discharge printed products, and a creation method of the printed products.

Description of the Related Art

Japanese Patent Application Laid-Open No. 2003-25667 discusses an apparatus that discharges printed products of each image group to a discharge unit in a state of shifting the printed products in a direction orthogonal to a conveyance direction through a sheet feeding mechanism.

Japanese Patent Application Laid-Open No. 2002-308517 discusses an apparatus that discharges printed products in a state of making a first sheet of subsequent image group to be a partition sheet when printed products of previous image group are stacked on the discharge unit.

However, with the apparatus discussed in Japanese Patent Application Laid-Open No. 2003-25667, product cost will be increased because it is necessary to provide a mechanism for shifting the printed products to be discharged in a direction orthogonal to the conveyance direction.

Further, with the apparatus discussed in Japanese Patent Application Laid-Open No. 2002-308517, running cost will be increased because it is necessary to discharge a partition sheet that is not a product.

SUMMARY OF THE INVENTION

According to an aspect of the present invention, an image forming apparatus is provided that is capable of reducing the product cost and the running cost while easily defining printed products of each image group.

According to another aspect of the present invention, an image forming apparatus includes an image forming unit configured to sequentially form images of an image group including a plurality of images on a continuous sheet while providing a non-printing region between the images, a cutting unit configured to cut the continuous sheet, a discharge unit to which printed products, on which an image is formed by the image forming unit and cut and created by the cutting unit, is discharged, and a control unit configured to execute a first control for controlling the cutting unit to create a first printed product by cutting the continuous sheet at a leading end and a trailing end of a region in which an image is formed by the image forming unit and to discharge the first printed product to the discharge unit, and configured to execute a second control for controlling the cutting unit to create a second printed product by cutting the continuous sheet while having the non-printing region of a predetermined size at a leading end or a trailing end of a region in which a first or a last image of the image group is formed by the image forming unit and to discharge the second printed product to the discharge unit.

Further features of the present invention will become apparent from the following description of exemplary embodiments with reference to the attached drawings.

DESCRIPTION OF THE EMBODIMENTS

Hereinafter, an ink-jet type printing apparatus will be described as an example of an image forming apparatus according to a first exemplary embodiment of the present invention. A printing apparatus according to the present exemplary embodiment is a high-speed line printer that supports both of one-sided and two-sided printing modes using a continuous sheet. For example, the printing apparatus according to the present exemplary embodiment is suitable for large volume printing performed in a professional printing shop. Herein, the continuous sheet refers to a long continuous sheet having a length longer than a repetitive printing unit (one page) in a conveyance direction. Further, one printing unit (one page) is referred to as a unit image when a plurality of pages is sequentially printed on the continuous sheet. In a case where a mixture of small images, characters, and spaces are included in a region of one printing unit (one page), these images, characters, and spaces included in that region are collectively referred to as one unit image. In addition, "unit image" may be simply referred to as "image". Further, a length of the unit image in a sheet conveyance direction may vary according to a size of the image to be printed. For example, an L-size photograph has a length of 135 mm in a sheet conveyance direction, whereas an A4-size photograph has a length of 297 mm in a sheet conveyance direction thereof.

The present invention is widely applicable to printing apparatuses such as a printer, a multifunction printer, a copying machine, a facsimile machine, and manufacturing apparatuses of various devices. Printing processing can be executed through any of the systems such as an ink-jet system, an electro-photographic system, a thermal transfer system, a dot impact system, and a liquid development system. Further, the present invention is also applicable to an apparatus for executing various kinds of processing (e.g., recording, treatment, coating, irradiation, reading, and inspection processing) on a continuous sheet in addition to the printing processing. Furthermore, in addition to the apparatus, the present invention is also applicable to a creation method of printed products employing the operations according to the present invention.

Figure 1:
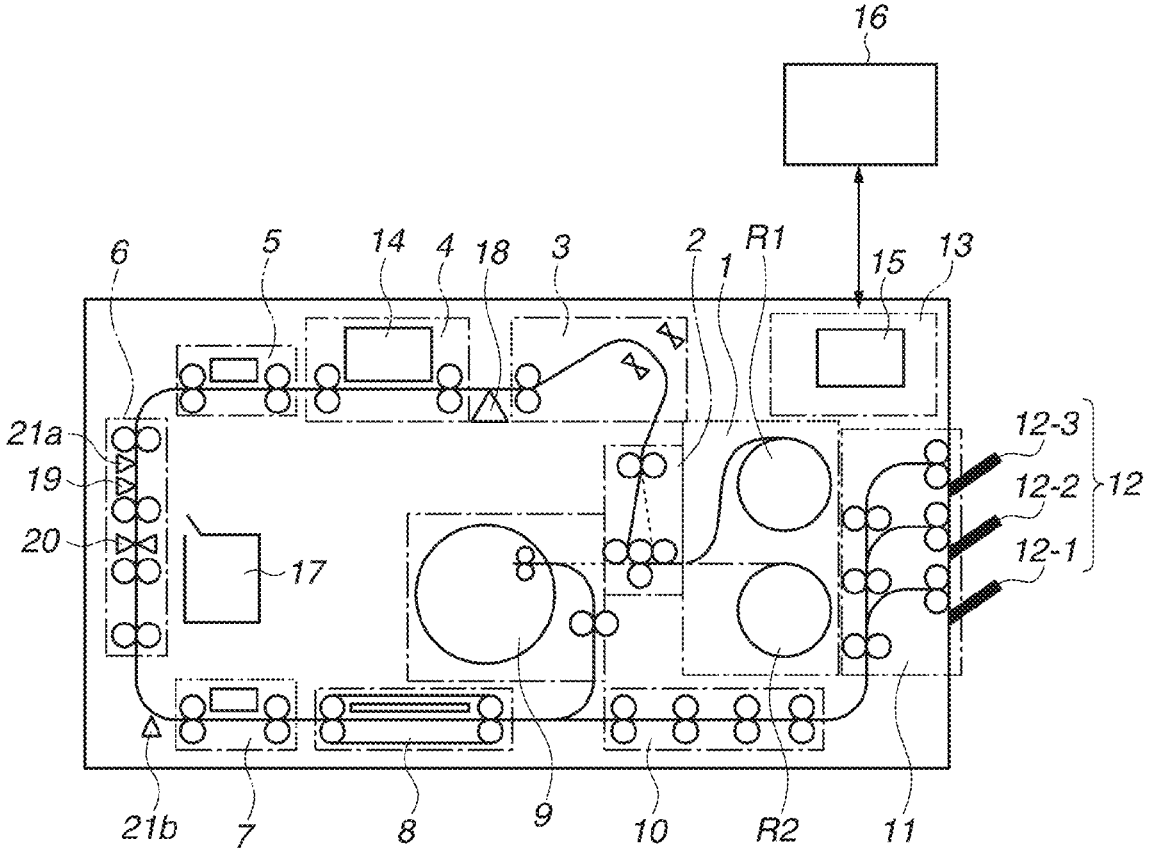
FIG. 1 is a schematic diagram illustrating an internal configuration of a printing apparatus.

First, a basic configuration of the printing apparatus will be described. FIG. 1 is a cross-sectional schematic diagram illustrating an internal configuration of the printing apparatus. The printing apparatus according to the present exemplary embodiment can execute two-sided printing on a first surface (front surface) and a second surface (back surface) opposite to the first surface of a sheet by using a long sheet (roll sheet) wound in a roll state. The printing apparatus internally includes various units such as a supply unit 1, a curl correction unit 2, a skew correction unit 3, a printing unit 4, an inspection unit 5, a cutter unit 6, an information recording unit 7, a drying unit 8, an inversion unit 9, a discharge conveyance unit 10, a sorter unit 11, a discharge unit 12, and a control unit 13. A sheet conveyance path is indicated by a solid line in FIG. 1. The sheet is conveyed by a conveyance mechanism configured of a roller pair and a belt, and processed by the respective units. Further, at one optional position in the conveyance path, one side close to the supply unit 1 is referred to as "upstream", whereas another side away from the supply unit 1 is referred to as "downstream". Furthermore, one side of a leading end of the sheet in the conveyance direction is simply referred to as "leading end side", whereas another side of a trailing end of the sheet is simply referred to as "trailing end side".

The supply unit 1 stores and supplies a long roll sheet (continuous sheet). The supply unit 1 can respectively store roll sheets in two rolls R1 and R2, and selectively draw and supply the sheet therefrom. In addition, the number of the storable roll sheets is not limited to two. Further, any continuous sheet other than the continuous sheet wound in a roll state may be used. For example, a continuous sheet that is perforated at each unit length and folded at each perforation may be stacked on and stored in the supply unit 1.

The curl correction unit 2 reduces a curl (warp) arising in the sheet supplied from the supply unit 1. When the sheet passes through the curl correction unit 2, two pinch rollers with respect to one driving roller are used to cause the sheet to be bent by applying a warp in an orientation opposite to the curl of the sheet, so that the curl arising in the sheet is reduced thereby.

The skew correction unit 3 corrects a skew (i.e., inclination with respect to the original conveyance direction) of the sheet that has passed through the curl correction unit 2. An edge portion on one side of the sheet regarded as a reference is pressed against a guiding member, so that the skew of the sheet is corrected.

A printing unit 4 corresponds to an image forming unit according to the present exemplary embodiment. The printing unit 4 executes printing processing on the conveyed sheet from the above through a print head 14 to form an image. In addition to the print head 14, the printing unit 4 includes a plurality of conveyance rollers for conveying the sheet. The print head 14 is a line-type ink-jet recording head having a nozzle array for discharging ink across a full width of the sheet assumed to be used. The print head 14 is configured of a plurality of print heads arranged in parallel with respect to the conveyance direction. In the present exemplary embodiment, the print head 14 includes seven print heads corresponding to seven colors of cyan (C), magenta (M), yellow (Y), light-cyan (LC), light-magenta (LM), gray (G), and K (black). In addition, according to the present invention, the number of the colors and the number of the print heads are not limited to seven. Further, various ink jet systems such as systems using a heating element, a piezoelectric element, an electrostatic element, and a micro electro mechanical system (MEMS) element can be employed. Various colors of ink are respectively supplied from ink tanks to the print head 14 via tubes.

The inspection unit 5 optically reads an inspection pattern or an image printed on a sheet by the printing unit 4 through a scanner to inspect a state of the print head nozzle, a conveyance state of the sheet, and an image position, and determines whether the image is printed correctly. The scanner includes a charge coupled device (CCD) image sensor or a complementary metal-oxide semiconductor (CMOS) image sensor.

The cutter unit 6 corresponds to a cutting unit according to the present invention. The cutter unit 6 includes a cutter 20 for cutting the sheet on which images are printed by the printing unit 4 into a predetermined length. The cutter 20 includes two mechanical cutters 20*a* and 20*b*. A non-printed region (hereinafter, referred to as "non-image region") between regions where images are formed on a sheet (hereinafter, referred to as "image regions") is efficiently cut off by the first cutter 20*a* on an upstream side and the second cutter 20*b* on a downstream side. A configuration for cutting off the non-image region between a first image region and a second image region subsequent to the first image region will be described. For example, an end portion on the trailing end side of the non-image region (i.e., an end portion on the leading end side of the second image region) is cut by the first cutter 20*a*, whereas an end portion on the leading end side of the non-image region (i.e., an end portion on the trailing end side of the first image region) is cut by the second cutter 20*b*.

The cutter unit 6 includes a cut mark sensor 19 (i.e., cut mark detection unit) capable of optically detecting a cut mark recorded on the sheet, a plurality of conveyance rollers for sending the sheet to the subsequent processing, and an edge sensor 21*a* used for detecting a leading end of the sheet. Further, a dust box 17 is provided in a vicinity of the cutter unit 6. The dust box stores a strip of paper (i.e., dust) of a non-image region cut off by the first and the second cutters 20*a* and 20*b*. The cutter unit 6 is provided with a sorting mechanism for sorting whether the cut sheet is to be discharged to the dust box 17 or to be transferred to the original conveyance path.

The information recording unit 7 records unique printing information such as a printing serial number or date on a back surface of the sheet cut into a unit image by the cutter unit 6. The information recording unit 7 records the printing information by printing characters or codes through the ink jet system or the thermal transfer system. The edge sensor 21*b* for detecting a leading end of the cut sheet is provided on the downstream side of the cutter unit 6 or the upstream side of the information recording unit 7. Timing for recording the information through the information recording unit 7 is controlled based on a detection timing of the edge sensor 21*b*.

The drying unit 8 heats the sheet printed by the printing unit 4 to dry the ink applied thereto in a short time. In the drying unit 8, hot air is applied at least from a lower surface of the sheet passing therethrough, so that the ink application surface is dried thereby. A drying method in which a surface of the sheet is irradiated with an electromagnetic wave (ultraviolet light or infrared light) may be employed instead of the drying method using hot air.

A conveyance path from the supply unit 1 to the drying unit 8 is referred to as a first path. The first path has a turn-around shape in a space between the printing unit 4 and the drying unit 8, and the cutter unit 6 is positioned partway through the turn-around shape.

The inversion unit 9 includes an inversion mechanism that temporarily winds up the sheet on which the printing is executed on a front surface (first surface) to invert front and back surfaces thereof when two-sided printing is executed. The inversion unit 9 supplies the sheet that has passed through the drying unit 8 to the printing unit 4 again. The inversion unit 9 is disposed partway through a conveyance path (referred to as a second path) where the sheet passes to reach the printing unit 4 from the drying unit 8 via the curl correction unit 2. The inversion mechanism includes a wind-up rotation member (drum) that rotates and winds up the sheet. The sheet the printing of which is executed on the front surface (first surface) is temporarily wound up by the wind-up rotation member. After the sheet is wound up, the wind-up rotation member rotates in a reverse direction, so that the wound sheet is supplied to the curl correction unit 2 and conveyed to the printing unit 4 in an order opposite to the wind-up order. Then, printing is executed on a back surface (second surface) of the sheet by the printing unit 4. The operation specifically executed in the two-sided printing mode will be described below.

The discharge conveyance unit 10 conveys the sheet cut by the cutter unit 6 and dried by the drying unit 8 to the sorter unit 11. The discharge conveyance unit 10 is disposed on a conveyance path (referred to as a third path) different from the second path where the inversion unit 9 is disposed. A path switching mechanism having a movable flapper, which guides the sheet conveyed through the first path to the second path or the third path, is provided on the printing apparatus.

The sorter unit 11 and the discharge unit 12 are disposed near the supply unit 1 at the end of the third path. The sorter unit 11 sorts the printed products for each group after the printing is executed. The printed products sorted by the sorter unit 11 are discharged to the discharge unit 12 configured of a plurality of discharge trays. As described above, the third path is a conveyance path for discharging the printed products after passing under the supply unit 1.

As described above, respective units such as the supply unit 1 to the drying unit 8 are sequentially disposed along the first path. The first path is branched into the second path and the third path in a region ahead of the drying unit 8, and the second path joins the first path in a region ahead of the inversion unit 9 disposed partway through the second path. The discharge unit 12 is disposed at the end of the third path.

The control unit 13 includes a control means for controlling respective units of the entire printing apparatus. The control unit 13 includes a central processing unit (CPU), a storage device, a controller including various control units, an external interface, and an operation unit 15 for allowing a user to execute an input-output operation. An operation of the printing apparatus is controlled based on an instruction from the controller or a host device 16 such as a host computer connected to the controller via the external interface.

A mark reading unit 18 is disposed between the skew correction unit 3 and the printing unit 4. The mark reading unit 18 includes a reflection type optical sensor that optically reads a reference mark recorded on the first surface of the sheet conveyed from the inversion unit 9 from the opposite side to the printed side. The mark reading unit 18 includes a light source (e.g., white light-emitting diode (LED)) for illuminating a surface of the sheet and a light receiving unit such as a photodiode or an image sensor for detecting reflection light from the sheet for each component of red, green, and blue (RGB components). The mark can be read through the change of signal level output from the light receiving unit or through the image analysis of captured image data.

Figure 2:
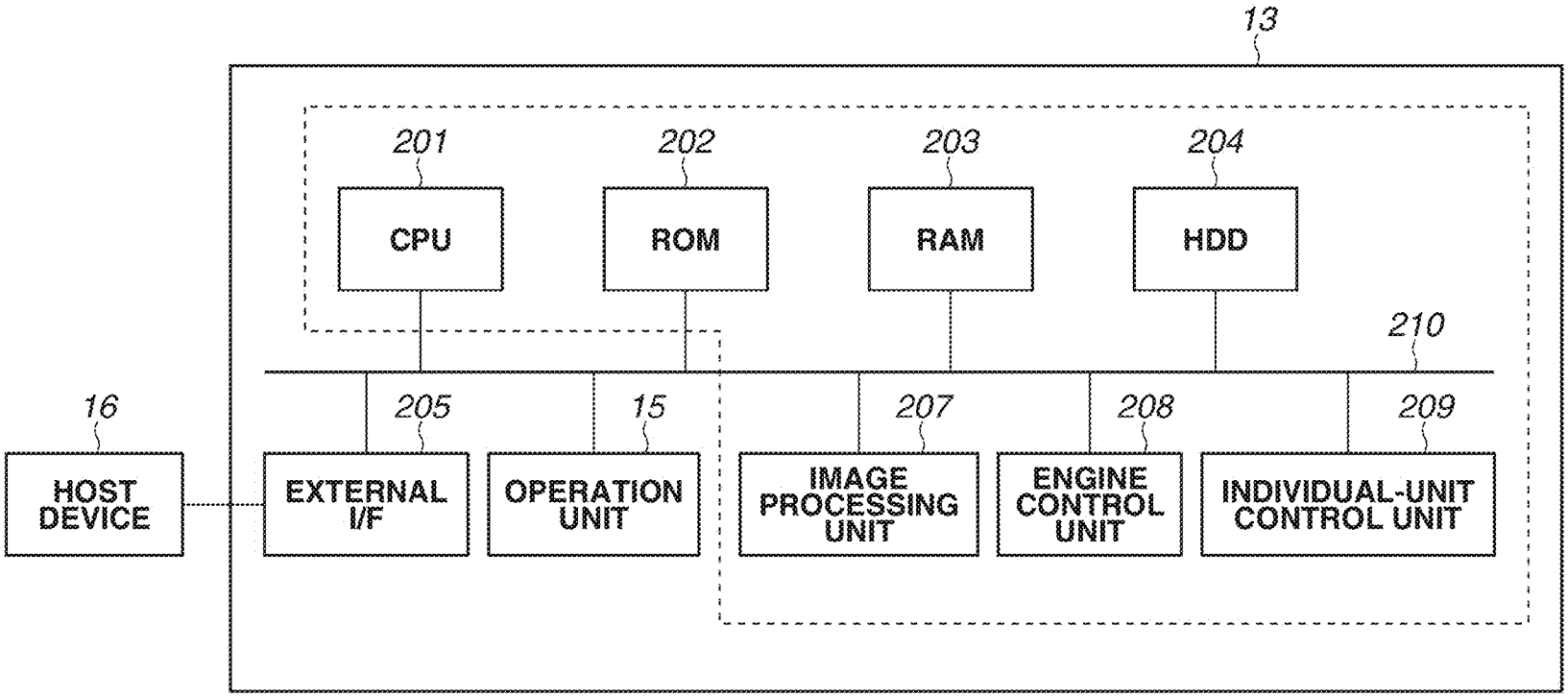
FIG. 2 is a block diagram of a control unit.

FIG. 2 is a block diagram illustrating a concept of the control unit 13. The controller (i.e., an area surrounded by a dashed line) included in the control unit 13 is configured of a central processing unit (CPU) 201, a read only memory (ROM) 202, a random access memory (RAM) 203, a hard disk drive (HDD) 204, an image processing unit 207, an engine control unit 208, and an individual-unit control unit 209. The CPU 201 generally controls operations of respective units included in the printing apparatus. The ROM 202 stores a program executed by the CPU 201 and fixed data necessary for the printing apparatus to execute various operations. The RAM 203 is used as a work area of the CPU 201, a region for temporarily storing various kinds of received data, and a region for storing various kinds of setting data. A program executed by the CPU 201, print data, and setting information necessary for the printing apparatus to execute various operations can be stored in and read from the HDD 204. The operation unit 15 serves as an input-output interface between the printing apparatus and a user, and includes an input unit such as a hard key or a touch panel and an output unit such as a display unit or an audio generation unit for presenting information.

A dedicated processing unit is prepared for a unit that requires high-speed data processing. The image processing unit 207 executes image processing of print data to be dealt with the printing apparatus. A color space of the input image data (e.g., YCbCr) is converted into a standard RGB color space (e.g., sRGB). Further, various kinds of image processing such as resolution conversion, image analysis, and image correction are executed on the image data as necessary. The print data acquired through the above-described image processing is stored in the RAM 203 or the HDD 204. Based on a control command received from the CPU 201, the engine control unit 208 executes driving control of the print head 14 of the printing unit 4 according to the print data. The engine control unit 208 further controls respective units within the printing apparatus. The individual-unit control unit 209 is a sub-controller for individually controlling the respective units such as the supply unit 1, the curl correction unit 2, the skew correction unit 3, the inspection unit 5, the cutter unit 6, the information recording unit 7, the drying unit 8, the inversion unit 9, the discharge conveyance unit 10, the sorter unit 11, and the discharge unit 12. Based on the instruction from the CPU 201, operations executed by the respective units are controlled by the individual-unit control unit 209. An external interface 205 is a local interface (I/F) or a network I/F serving as an interface for connecting the controller to the host device 16. The above-described constituent elements are connected to each other through a system bus 210.

The host device 16 serves as a supply source of image data that is to be printed by the printing apparatus. The host device 16 may be a general-purpose or a dedicated computer, or may be a dedicated imaging device such as an image capture device including an image reader unit, a digital camera, and a photo storage device. In a case where the host device 16 is a computer, an operating system (OS), application software for generating image data, and a printer driver for the printing apparatus are installed in a storage device included in the computer. In addition, an entire portion of the above-described processing does not have to be realized by the software, and all or a part of the processing may be realized by the hardware.

Next, operations executed by the printing apparatus when printing will be described. Because the printing apparatus executes different operations in the one-sided printing mode and the two-sided printing mode, the operations will be described respectively.

Figure 3A:
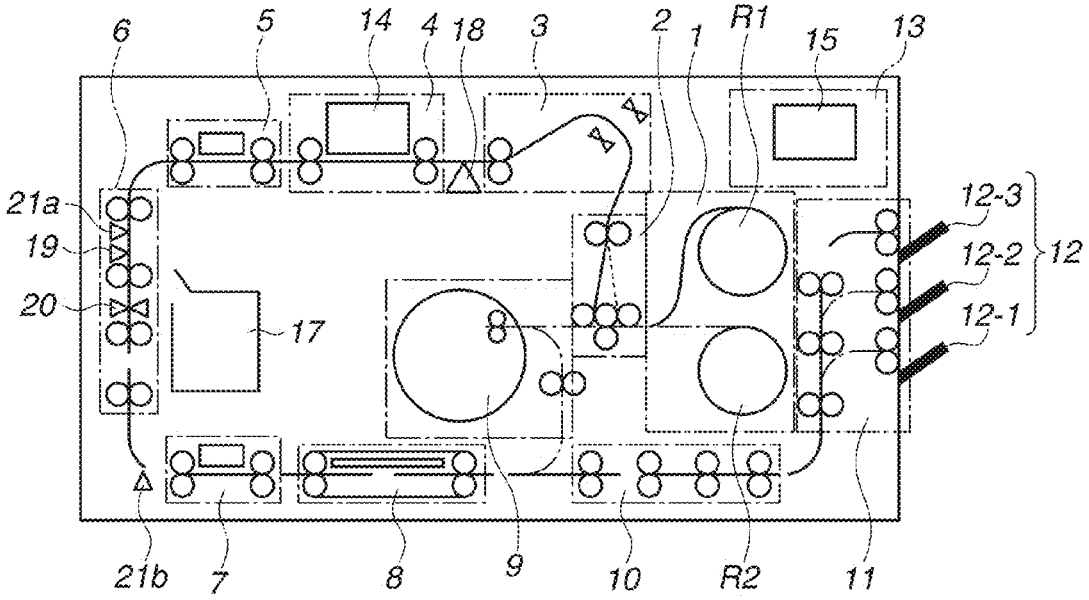
FIGS. 3A and 3B are diagrams illustrating operations executed in a one-sided printing mode and a two-sided printing mode.

First, the operation in the one-sided printing mode will be described. FIG. 3A is a diagram illustrating the operation in the one-sided printing mode. In the printing unit 4, printing processing is executed on a front surface (first surface) of the continuous sheet supplied from the supplying unit 1 and processed by the curl correction unit 2 and the skew correction unit 3. The printing unit 4 sequentially forms images of a predetermined unit length (i.e., unit images) in a conveyance direction on the continuous sheet. The printing unit 4 forms the images while providing a non-image region of a predetermined size between the consecutive images, and records a cut mark on the non-image region. The continuous sheet on which the images are formed is conveyed via the inspection unit 5 and cut into unit images by the cutter 20 provided on the cutter unit 6 based on the cut marks detected by the cut mark sensor 19. The information recording unit 7 records the print information on the back surfaces (second surfaces) of the sheets cut into unit images as necessary. Then, the sheets are conveyed to and dried by the drying unit 8 one-by-one. Thereafter, the sheets are sequentially discharged and stacked onto the discharge unit 12 of the sorter unit 11 via the discharge conveyance unit 10. On the other hand, the continuous sheet from which the last unit image is cut off, and left on the side of the printing unit 4, is sent back to the supply unit 1 and wound up by the roll R1 or R2.

As described above, in the one-sided printing mode, the continuous sheet is processed while passing through the first and the third paths without passing through the second path. Accordingly, in the one-sided printing mode, the following sequences 1 to 6 are executed according to the control of the control unit 13.

1. The continuous sheet is supplied to the printing unit 4 from the supply unit 1.
2. The printing unit 4 repeatedly forms unit images and records cutting marks on a first surface of the continuous sheet supplied thereto.
3. The cutter unit 6 repeatedly cuts the unit images formed on the first surface.
4. The sheets cut into the unit images pass through the drying unit 8 one-by-one.
5. The sheets having passed through the drying unit 8 are discharged to the discharge unit 12 through the third path.
6. The continuous sheet from which the last unit image is cut off, and left on the side of the printing unit 4, is sent back to the supply unit 1.

Figure 3B:
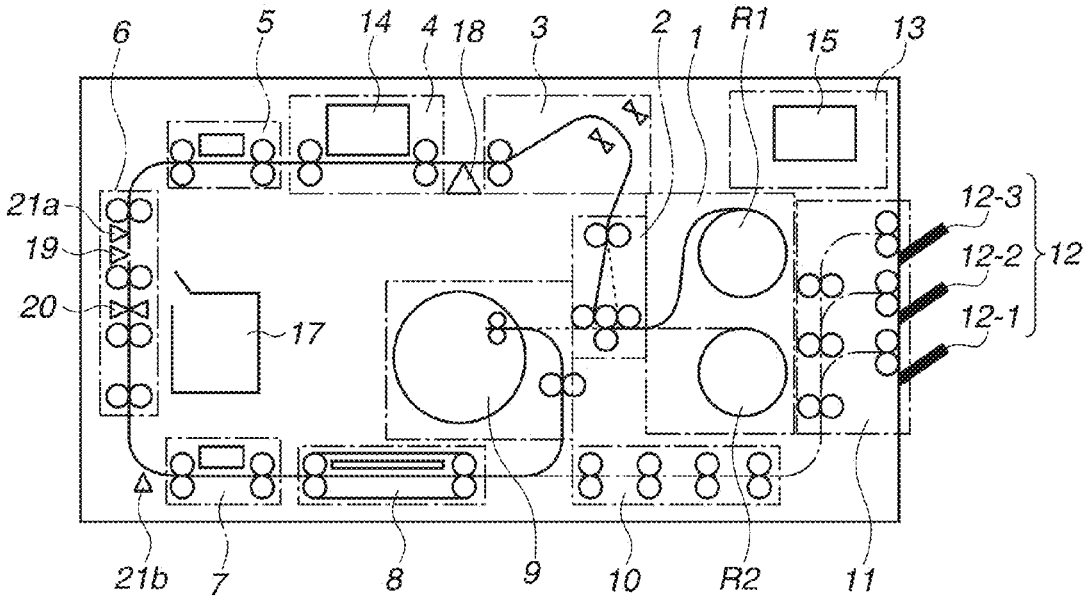

Next, the operation in the two-sided printing mode will be described. FIG. 3B is a diagram illustrating the operation in the two-sided printing mode. In the two-sided printing mode, a back surface printing sequence is executed subsequent to the front surface printing sequence. The operations in the front surface printing sequence, executed by the respective units such as the supply unit 1 to the inspection unit 5, are the same as those executed in the above-described one-sided printing mode. In the two-sided printing mode, the continuous sheet is conveyed to the drying unit 8 as it is without being cut by the cutter unit 6. After the ink applied to the front surface is dried by the drying unit 8, the continuous sheet is conveyed to the second path instead of the third path. In the second path, the continuous sheet is wound up by the wind-up rotation member of the inversion unit 9 rotating in a forward direction (in FIG. 3A, counter-clockwise direction). When all of the images on the front surface are printed by the printing unit 4, an end portion on the trailing end side of the last image region is cut by the cutter unit 6. The downstream side of the continuous sheet (printed side) in the conveyance direction of the cutting position as a reference, is entirely wound up via the drying unit 8 by the inversion unit 9 up to the rear end portion (cutting position) thereof. On the other hand, the upstream side of the cutting position of the continuous sheet (unprinted side) is wound up by the roll R1 or R2. Because the unprinted continuous sheet is wound up by the roll R1 (R2), it is possible to prevent collision between the unprinted continuous sheet and the continuous sheet that is to be supplied again in the back surface printing sequence described below.

After the above-described front surface printing sequence is executed, the operation is switched to the back surface printing sequence. The wind-up rotation member of the inversion unit 9 rotates in a direction opposite to the wind-up direction (in FIG. 3B, clockwise direction). The continuous sheet supplied from the wind-up rotation member is conveyed to the curl correction unit 2 along the path indicated by a dashed line in FIG. 3B. The portion that was the trailing end when the continuous sheet was wound up by the wind-up rotation member will be the leading end when the continuous sheet is supplied from the wind-up rotation member. A curl of the continuous sheet applied by the wind-up rotation member is corrected by the curl correction unit 2. The curl correction unit 2 is disposed between the supply unit 1 and the printing unit 4 in the first path and between the inversion unit 9 and the printing unit 4 in the second path, so that the curl correction unit 2 serves as a common unit that executes curl correction in both of the first and the second paths. The continuous sheet the front and back surfaces of which are inverted is conveyed to the printing unit 4 via the skew correction unit 3, so that unit images are formed and cut marks are recorded on the back surface thereof. The continuous sheet on the back surface of which the images are formed is conveyed via the inspection unit 5 and cut into unit images by the cutter unit 6 based on the cut marks. In a case where printing is executed on two sides thereof, the information is not recorded by the information recording unit 7 because images are formed on the back surfaces of the sheets. The cut sheets are conveyed to the drying unit 8, and sequentially discharged and stacked onto the discharge unit 12 of the sorter unit 11 via the discharge conveyance unit 10.

As described above, in the two-sided printing mode, the continuous sheet is processed while passing through the respective paths in the order of the first, the second, the first, and the third paths. Accordingly, in the two-sided printing mode, the following sequences 1 to 11 will be executed according to the control of the control unit 13.

1. The continuous sheet is supplied to the printing unit 4 from the supply unit 1.
2. The printing unit 4 repeatedly forms unit images on the first surface of the continuous sheet supplied thereto.
3. The continuous sheet on the first surface of which the images are formed passes through the drying unit 8.
4. The continuous sheet having passed through the drying unit 8 is wound up by the wind-up rotating member of the inversion unit 9.
5. An end portion on the trailing end side of the last image region printed on the first surface is cut by the cutter unit 6.
6. The continuous sheet is wound up by the wind-up rotating member until the end portion on the trailing end side of the cut continuous sheet passes through the drying unit 8 to reach the wind-up rotating member. The unprinted continuous sheet is sent back to the supply unit 1.

7. When the continuous sheet has been wound up, the wind-up rotating member is rotated in a reverse direction, so that the continuous sheet is supplied to the printing unit 4 again through the second path.
8. The printing unit 4 repeatedly forms unit images and records cutting marks on the second surface of the continuous sheet.
9. The cutter unit 6 repeatedly cuts the unit images formed on the second surface.
10. The sheets cut into the unit images pass through the drying unit 8 one-by-one.
11. The sheets having passed through the drying unit 8 are discharged to the discharge unit 12 through the third path.

Next, cutting and discharging operations executed by the printing apparatus having the above-described configuration will be described further in detail.

Figure 4:
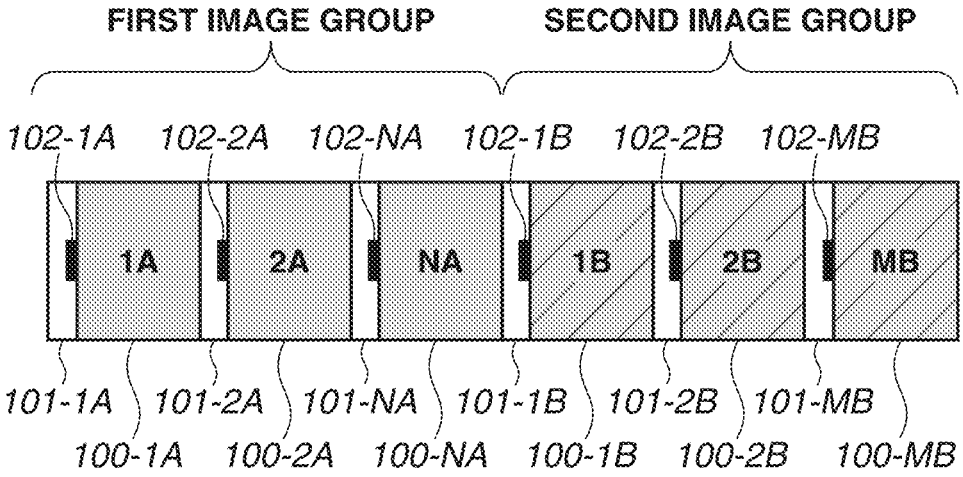
FIG. 4 is a diagram illustrating an arrangement of a plurality of images sequentially printed on a continuous sheet according to a first exemplary embodiment.

FIG. 4 is a diagram illustrating an arrangement of a plurality of images (images 1A, 2A, . . . , NA, 1B, 2B, . . . , and MB) sequentially formed on the continuous sheet. In FIG. 4, image regions 100 (i.e., image regions 100-1A to 100-NA) and non-image regions 101 (i.e., non-image regions 101-1A to 101-NA) are alternately arranged in a first image group. Cut marks 102 (i.e., cut marks 102-1A to 102-NA) are formed on the non-image regions 101. Hereinafter, for example, an image region 100-1A, a non-image region 101-1A, and a cut mark 102-1A of the image 1A are respectively referred to as an image region 1A, a non-image region 1A, and a cut mark 1A. Further, image regions 100 (i.e., image regions 100-1B to 100-MB) and non-image regions 101 (i.e., non-image regions 101-1B to 101-MB) are alternately arranged in a second image group. The cut marks 102 (i.e., cut marks 102-1B to 102-MB) are recorded on the non-image regions 101 (i.e., non-image regions 101-1B to 101-MB). Similar to the image 1A, an image region 100-1B, a non-image region 101-1B, and a cut mark 102-1B of the image 1B are respectively referred to as an image region 1B, a non-image region 1B, and a cut mark 1B.

FIGS. 5A to 5E are diagrams illustrating a first operation (i.e., normal cutting process) according to the present exemplary embodiment. As illustrated in FIGS. 5A to 5E, the continuous sheet on which the images of the first and the second image groups are formed is cut by the cutter 20, and the created printed products are discharged and stacked onto a discharge tray 12-1. Herein, for the sake of simplicity, the number of images included in each of the image groups is set to two. However, the image group may consist of any number of the images (one or more).

Figures 5A, 5B, 5C, 5D, 5E:
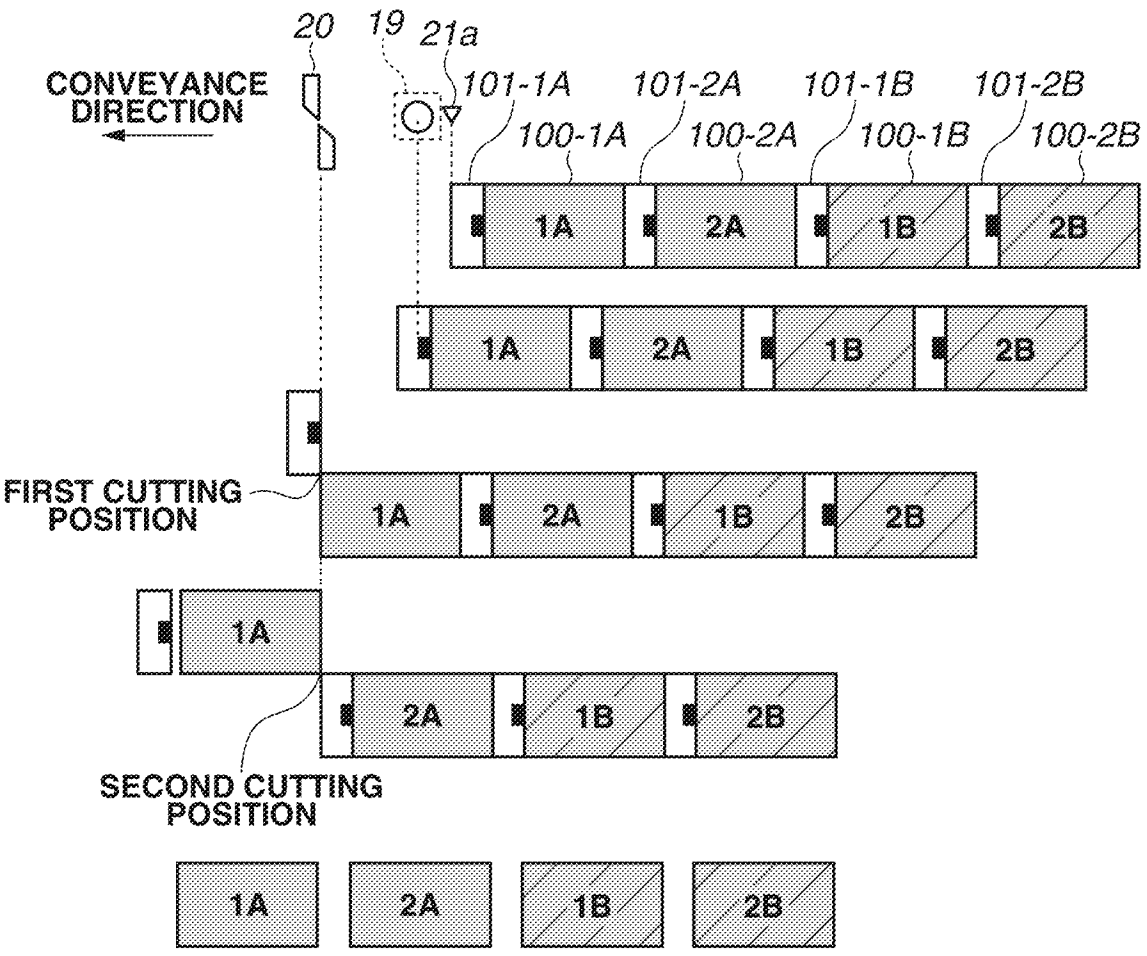
FIGS. 5A, 5B, 5C, 5D and 5E are diagrams illustrating a cutting process in a first operation according to the first exemplary embodiment.

First, as illustrated in FIG. 5A, when the continuous sheet is conveyed, the edge sensor 21*a* disposed in a vicinity of the cut mark sensor 19 detects the leading end portion of the continuous sheet. Thereafter, as illustrated in FIG. 5B, the continuous sheet is further conveyed, and the cut mark sensor 19 detects the cut mark 1A. Then, the first and second cutting positions that are to be cut by the cutter 20 and a starting position for reading the subsequent cut mark 2A are set. Next, when the continuous sheet is conveyed up to a point where the first cutting position reaches the cutter 20, the conveyance of the continuous sheet is stopped so that the continuous sheet is cut by the cutter 20 at the first cutting position. At this time, as illustrated in FIG. 5C, the continuous sheet is cut into two portions, i.e., a strip of paper including the non-image region 1A and a continuous sheet in which the image region 1A and the subsequent image regions are connected. Next, when the continuous sheet in which the image region 1A and the subsequent image regions are connected is further conveyed up to a point where the second cutting position reaches the cutter 20, the conveyance of the continuous sheet is stopped so that the continuous sheet is cut at the second cutting position. With this operation, as illustrated in FIG. 5D, the image region 1A is cut off from the continuous sheet. Then, the operations illustrated in FIGS. 5B to 5D are executed repeatedly, so that the image regions and the non-image regions are cut off sequentially. Next, the cut strip of paper including the non-image region is discharged to the dust box 17. Further, as illustrated in FIG. 5E, the sheets including the image regions cut off from the continuous sheet (hereinafter, referred to as "printed products") are conveyed to the sorter unit 11. Then, the printed products on which the images of the first image group (images 1A and 2A) are formed, which are conveyed to the sorter unit 11, are discharged and stacked onto the discharge tray 12-1. Similarly, the printed products on which the images of the second image group (images 1B and 2B) are formed are also discharged and stacked onto the discharge tray 12-1.

Figures 6A, 6B, 6C, 6D, 6E, 6F:
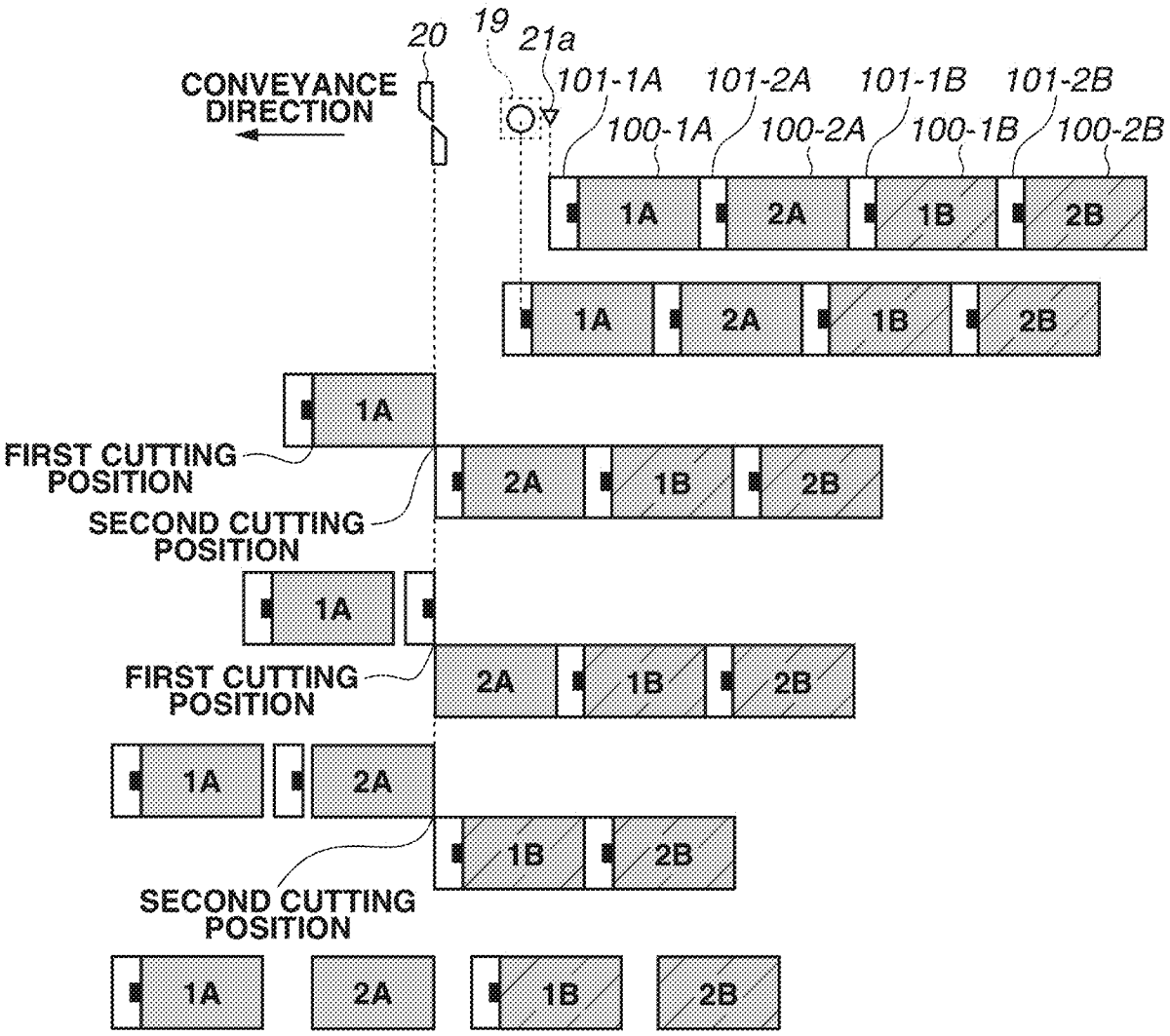
FIGS. 6A, 6B, 6C, 6D, 6E, and 6F are diagrams illustrating a cutting process in a second operation according to the first exemplary embodiment.

FIGS. 6A to 6F are diagrams illustrating a second operation (i.e., cutting process characteristic for the present invention) according to the present exemplary embodiment. As illustrated in FIGS. 6A to 6F, the continuous sheet on which the images of the first and the second image groups are formed is cut by the cutter unit 6, so that the created printed products are discharged and stacked onto the discharge tray 12-1. First, as illustrated in FIG. 6A, when the continuous sheet is conveyed, the edge sensor 21*a* disposed in the vicinity of the cut mark sensor 19 detects the leading end portion of the continuous sheet. Then, as illustrated in FIG. 6B, the continuous sheet is further conveyed, so that the cut mark sensor 19 detects the cut mark 1A. Then, the first and the second cutting positions that are to be cut by the cutter 20 and a starting position for reading the next cut mark 2A are set. Subsequently, the continuous sheet is conveyed up to a point where the first cutting position reaches the cutter 20. At this time, the continuous sheet is conveyed while the non-image region 1A positioned on the leading end side of the first image region 1A of the first image group is not cut by the cutter 20. In other words, the continuous sheet is not cut at the first cutting position. Then, when the continuous sheet is conveyed up to a point where the second cutting position reaches the cutter 20, the conveyance of the continuous sheet is stopped so that the continuous sheet is cut by the cutter 20 at the second cutting position. In other words, the first image region 1A of the first image group is cut off while a predetermined size of the non-image region 1A is left on the leading end side thereof. Thus, as illustrated in FIG. 6C, the non-image region 1A and the image region 1A are connected on the sheet that is cut off in this way. Then, the conveyance of the continuous sheet is continued, so that the cut mark sensor 19 detects the cut mark 2A, the next first and the second cutting positions that are to be cut by the cutter 20 and a starting position for reading the next cut mark 1B are set. Next, when the continuous sheet is conveyed up to a point where the first cutting position reaches the cutter 20, the conveyance of the continuous sheet is stopped and the continuous sheet is cut by the cutter 20 at the first cutting position. At this time, as illustrated in FIG. 6D, the continuous sheet is cut into two portions, i.e., a strip of paper including the non-image region 2A and a continuous sheet in which the image region 2A and the subsequent image regions are connected. Next, when the continuous sheet in which the image region 2A and the subsequent image regions are connected is conveyed up to a point where the second cutting position reaches the cutter 20, the conveyance of the continuous sheet is stopped so that the continuous sheet is cut by the cutter 20 at the second cutting position. Therefore, as illustrated in FIG. 6E, the image region 2A is cut off from the continuous sheet. Further, when the first cut mark 1B of the second image group is detected by the cut mark sensor 19, the operation illustrated in FIG. 6C is executed similarly, and the operation illustrated in FIG. 6D is executed on the image regions subsequent to the image region 1B of the second image group. Then, the cut strip of paper including the non-image region is discharged to the dust box 17. The first printed product of the first image group conveyed to the sorter unit 11 is a printed product in which the image region 1A and the non-image region 1A are connected. The second and the subsequent printed products each are a printed product including only the image region 2A. Similarly, the first printed product of the second image group is a printed product in which the image region 1B and the non-image region 1B are connected. As illustrated in FIG. 6F, the second and the subsequent printed products each are a printed product including only the image region 2B. Then, the printed products on which the images of the first and the second image groups are formed, which are conveyed to the sorter unit 11, are sequentially discharged and stacked onto the discharge tray 12-1.

Figure 7:
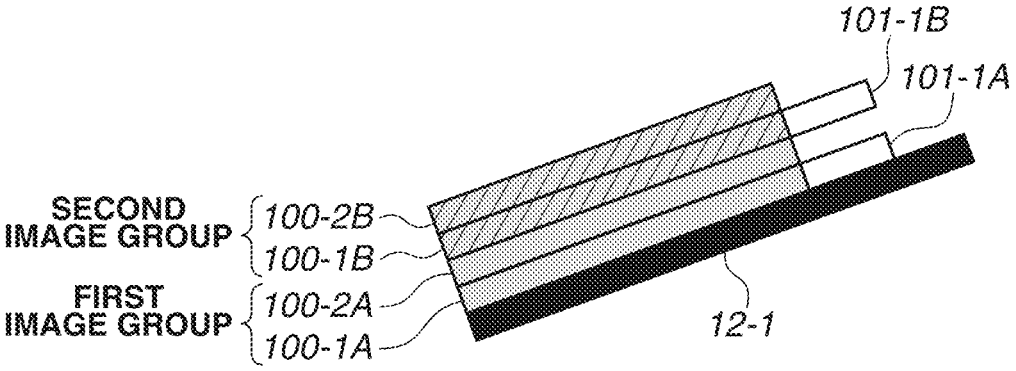
FIG. 7 is a diagram illustrating a state of printed products stacked on a discharge unit according to the first exemplary embodiment.

FIG. 7 is a diagram illustrating a state where the printed products on which the images of the first and the second image groups are formed are stacked on the discharge tray 12-1 of the discharge unit 12. As described above, the first printed product of the first image group is a printed product in which the image region 1A and the non-image region 1A are connected. Further, the first printed product of the second image group is also a printed product in which the image region 1B and the non-image region 1B are connected. Therefore, each of the first printed products is stacked thereon while sticking out from the printed products including only the image regions (i.e., image regions 2A and 2B) by the length of the non-image region. In the present exemplary embodiment, because the non-image region is provided on the leading end of the image region, a portion of the non-image region sticks out on the downstream side in the discharge direction of the printed product when the printed product is discharged. In this way, the user can easily recognize the printed product having the non-image region as a partition sheet. Further, even if the printed products are randomly stacked on the discharge tray, the image region and the non-image region can be recognized easily, and thus the user can sort the image group by identifying the non-image region.

In addition, with respect to the printed products stacked on the discharge tray 12-1, the post-processing process such as a cutting process and a bookbinding process will be executed for each image group later. In the post-processing process, the printed products are cut into a desired size and made up according to the selection of the user. As it is expected that the printed products will be cut when the post-processing process is executed, a mark may be printed on a cutting position when the image forming operation is executed. Even if the above-described printed product in which the image region and the non-image region are connected is included in the printed products for each image group, the non-image region is cut off from the printed product through the post-processing process. Therefore, the user can acquire the printed product similar to the other printed products, including the image region with an appropriate size.

Herein, the non-image region is provided on the leading end of the first image region of the image group. However, the same effect can be acquired when the non-image region is provided on the leading end of the last image region of the image group. Further, the non-image region can be provided on the trailing end of the first or the last image region of the image group. Furthermore, the non-image region can be provided on both of the leading end and the trailing end of the first and the last image regions of the image group. In other words, the non-image region can be provided on at least any one of the leading end and the trailing end of at least any one of the first and the last image regions of the image group.

As described above, in the two-sided printing mode, because the leading end side and the trailing end side are reversed at the inversion unit 9, one side that has been the trailing end side in the front surface (first surface) printing operation becomes the leading end side in the back surface (second surface) printing operation. Therefore, in order to make the non-image region stick out on the downstream side of the discharge unit 12 as described above, in the two-sided printing mode, the continuous sheet may be cut while a predetermined size of the non-image region is provided on the trailing end of the last image region after the last image of the image group is formed on the front surface (first surface).

Further, according to the present exemplary embodiment, the user may be allowed to select whether to execute the operation (second operation) for discharging the printed product including the non-image region to the discharge unit 12 or to execute the normal operation (first operation), through the operation unit 15 serving as the input unit illustrated in FIG. 1. Further, the user may be allowed to select whether to provide a non-image region on the first and/or last printed products of the image group, and whether to provide a non-image region on the leading end and/or the trailing end of the printed product. Furthermore, the information of each image group may be input through the operation unit 15 serving as the input unit, so that information based on the input information is recorded on the non-image region by the printing unit 4. By allowing the user to optionally make the above-described settings, a sorting mode can be selected according to the user's determination.

As described above, according to the present exemplary embodiment, by using the non-image region efficiently, the running cost is not increased. Further, since an additional mechanism is not required for the main unit, the production cost will not be increased. Therefore, it is possible to provide an image forming apparatus capable of easily defining the printed products of each image group at low cost.

A basic configuration of the printing apparatus according to a second exemplary embodiment of the present invention is similar to the configuration described according to the first exemplary embodiment, and thus illustration and description of the configuration thereof will be omitted.

In the present exemplary embodiment, operations different from those described in the first exemplary embodiment, i.e., operations from the image forming operation to the cutting and discharging operation executed by the printing apparatus, will be described in detail.

Figure 8:
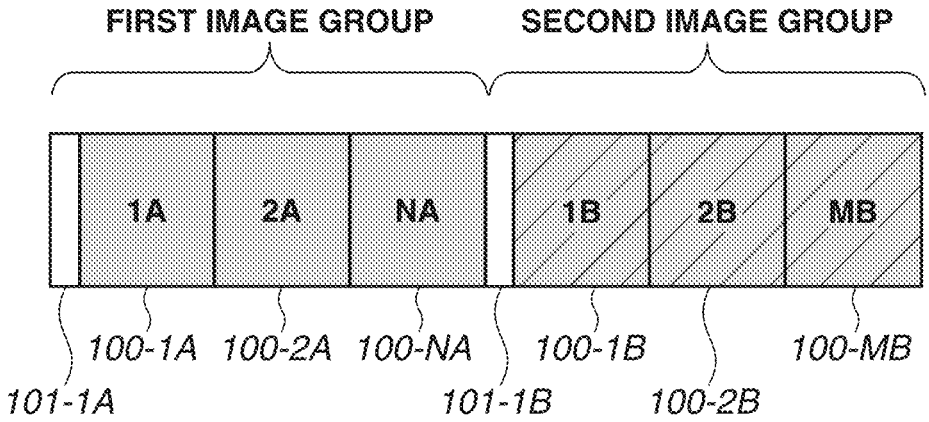
FIG. 8 is a diagram illustrating an arrangement of a plurality of images sequentially printed on a continuous sheet according to a second exemplary embodiment.

FIG. 8 is a diagram illustrating an arrangement of a plurality of images (images 1A, 2A, . . . , NA, 1B, 2B, . . . , and MB) formed on the continuous sheet according to the present exemplary embodiment. In FIG. 8, the printing unit 4 sequentially forms the images of the first image group without providing the non-image regions between the images. Similarly, the printing unit 4 sequentially forms the images of the second image group without providing the non-image regions between the images. In the image forming process according to the present exemplary embodiment, each of the first image regions of the image groups is formed with a predetermined size of the non-image region being provided on a leading end side thereof. Therefore, the non-image regions (non-image regions 1A . . . , 1B . . . ) are provided on the leading end sides of the first image regions (image regions 1A . . . , 1B . . . ) of the image groups. The non-image regions can be provided when the continuous sheet is conveyed through the printing unit 4 without image formation.

FIGS. 9A to 9D are diagrams illustrating a state where the continuous sheet on which the images of the first and the second image groups are formed is cut by the cutter 20, and the created printed products are discharged and stacked onto the discharge tray 12-1 of the discharge unit 12 according to the present exemplary embodiment. Herein, for the sake of simplicity, the number of images included in each of the image groups is set to two. However, the image group may consist of any number of the images (one or more).

Figures 9A, 9B, 9C, 9D:
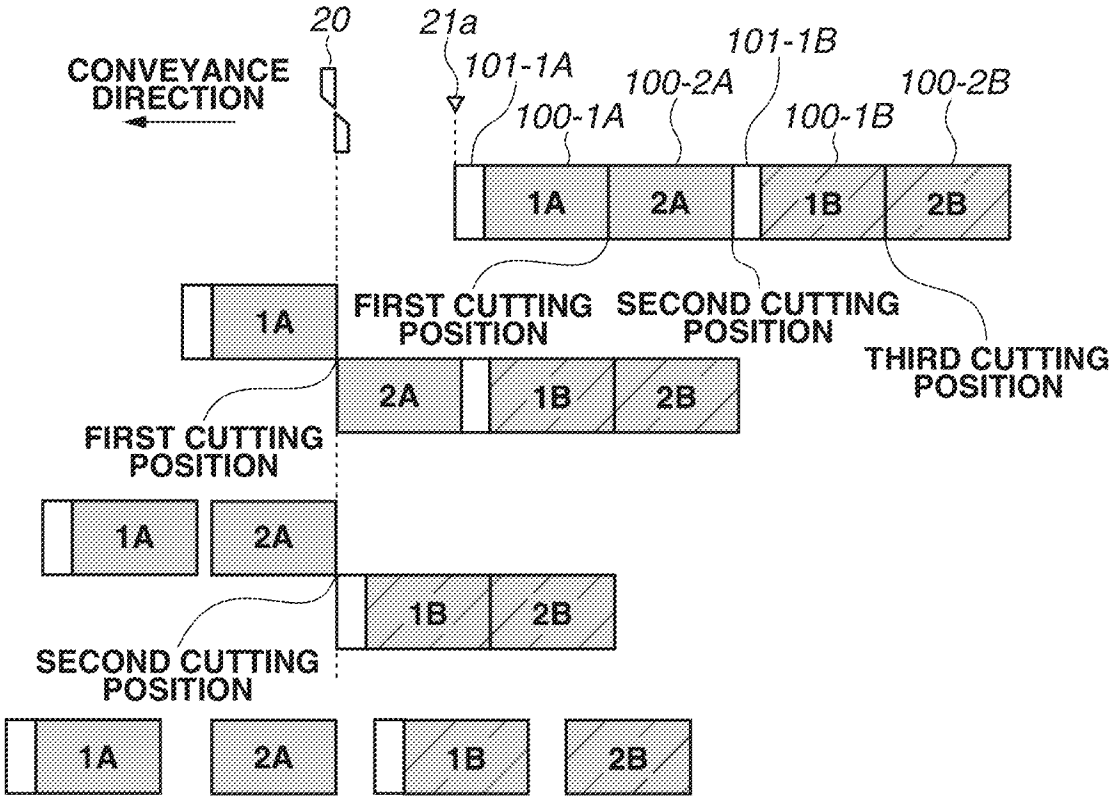
FIGS. 9A, 9B, 9C, and 9D are diagrams illustrating a cutting process in an operation according to the second exemplary embodiment.

First, as illustrated in FIG. 9A, when the continuous sheet is conveyed and the leading end portion of the continuous sheet is detected by the edge sensor 21*a*, the first cutting position, the second cutting position, and the third cutting position that are to be cut by the cutter 20 are set based on the position information of the detected leading end portion. Herein, each of the cutting positions is set to a boundary between the image regions. The boundary refers to a junction between one image region and another image region subsequent to the one image region. Even if the formed images slightly overlap with each other or have a small gap at the junction because of misalignment or blurring of the images, the junction is still allowed as the boundary. Next, as illustrated in FIG. 9B, when the continuous sheet is conveyed up to a point where the first cutting position reaches the cutter 20, the conveyance of the continuous sheet is stopped so that the continuous sheet is cut by the cutter 20 at the first cutting position. Next, as illustrated in FIG. 9C, when the continuous sheet is conveyed up to a point where the second cutting position reaches the cutter 20, the conveyance of the continuous sheet is stopped so that the continuous sheet is cut by the cutter 20 at the second cutting position. Then, the operations illustrated in FIGS. 9B and 9C are executed repeatedly, and the cutting process is completed when the continuous sheet is cut into the image regions.

In the present exemplary embodiment, a printed product on which the first image of the first image group is formed is a printed product in which the image region 1A and the non-image region 1A are connected. The second and the subsequent printed products each are a printed product including only the image region 2A. Similarly, the printed product on which the first image of the second image group is formed is a printed product in which the image region 1B and the non-image region 1B are connected. As illustrated in FIG. 9D, the second and the subsequent printed products each are a printed product including only the image region 2B. Then, the printed products on which the images of the first and the second image groups are formed, which are conveyed to the sorter unit 11, are sequentially discharged and stacked onto the discharge tray 12-1.

FIG. 7 is a diagram illustrating a state where the printed products on which the images of the first and the second image groups are formed are stacked on the discharge tray 12-1 of the discharge unit 12. As described above, the first printed product of the first image group is a printed product in which the image region 1A and the non-image region 1A are connected. Further, the first printed product of the second image group is also a printed product in which the image region 1B and the non-image region 1B are connected. Therefore, each of the first printed products is stacked thereon while sticking out from the printed products including only the image regions (i.e., image regions 2A and 2B) by the length of the non-image region. In the present exemplary embodiment, because the non-image region is provided on the leading end side of the image region, a portion of the non-image region sticks out on the downstream side in the discharge direction of the printed product when the printed product is discharged. Therefore, the user can easily recognize the printed product including the non-image region as a partition sheet. Further, even if the printed products are randomly stacked on the discharge tray, the image region and the non-image region can be recognized easily, and thus the user can sort the image groups by identifying the non-image regions.

In addition, with respect to the printed products stacked on the discharge tray 12-1, the post-processing process such as the cutting process and bookbinding process will be executed for each image group later. In the post-processing process, the printed products are cut into a desired size and made up according to the selection of the user. As it is expected that the printed products will be cut when the post-processing process is executed, a mark may be printed on a cutting position when the image forming operation is executed. Even if the above-described printed product in which the image region and the non-image region are connected is included in the printed products for each image group, the non-image region is cut off from the printed product through the post-processing. Therefore, the user can acquire the printed product similar to the other printed products, including the image region with an appropriate size.

In the second exemplary embodiment, the non-image region is provided on the leading end of the first image region of the image group. However, the same effect can be acquired when the non-image region is provided on the leading end of the last image region of the image group. Further, the non-image region can be provided on the trailing end of the first or the last image region of the image group. Furthermore, the non-image region can be provided on both of the leading end and the trailing end of the first and the last image regions of the image group. In other words, the non-image region can be provided on at least any one of the leading end and the trailing end of at least any one of the first and the last image regions of the image group.

Note that, in the two-sided printing mode, because the leading end side and the trailing end side are reversed at the inversion unit 9, one side that has been the trailing end side in the front surface (first surface) printing operation becomes the leading end side in the back surface (second surface) printing operation. Therefore, in order to make the non-image region stick out on the downstream side of the discharge unit 12 as described above, in the two-sided printing mode, the non-image region is provided on the trailing end of the image region when the last image of the image group is formed on the front surface (first surface). Then, the user may cut that non-image region provided on the trailing end.

Further, according to the present exemplary embodiment, the user may be allowed to select whether to execute the operation for discharging the printed product including the non-image region to the discharge unit 12 or to execute the normal operation through the operation unit serving as the input unit illustrated in FIG. 1. Further, the user may be allowed to select whether to provide a non-image region on the first printed product and/or the last printed product of the image group, and whether to provide a non-image region on the leading end and/or the trailing end of the printed product. Furthermore, the information of each image group may be input through the operation unit 15 serving as the input unit, so that information based on the input information is recorded on the non-image region by the printing unit 4. By allowing the user to optionally make the above-described settings, a sorting mode can be selected by the user's determination.

As described above, according to the present exemplary embodiment, it is possible to reduce the running cost because the printed products are provided with a small non-image region to distinguish the printed product of each image group. Further, it is possible to prevent increase in the production cost caused by the additional mechanism for the main unit. Therefore, it is possible to provide the image forming apparatus capable of easily defining the printed products of each image group at low cost.

In other words, according to the present invention, because at least any one of the first and the last printed products of each image group is discharged as a printed product having a non-image region serving as a partition, it is possible to provide the image forming apparatus capable of easily defining the printed materials of each image group at low cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-249375, filed Dec. 9, 2014, which is hereby incorporated by reference herein in its entirety.

What is claimed is:

1. An image forming apparatus comprising:

an image forming unit configured to sequentially form images of an image group including a plurality of images on a continuous sheet while providing a non-image region between the images;

a cutting unit configured to cut the continuous sheet;

a discharge tray to which printed products are discharged; and a control unit configured to execute a first control for controlling the cutting unit to create a first printed product by cutting the continuous sheet at a leading end and a trailing end of a first region in which an image is formed by the image forming unit, and discharging the first printed product which includes the first region to the discharge tray, and a second control for controlling the cutting unit to create a second printed product by cutting the continuous sheet while having a non-image region at at least any one of a leading end and a trailing end of a second region in which at least any one of a first image and a last image of the image group is formed by the image forming unit, and discharging the second printed product which includes the second region and the non-image region to the discharge tray.

2. The image forming apparatus according to claim 1, wherein, subsequent to printed products on which images of a first image group are formed, printed products, on which images of a second image group subsequent to the first image group are formed, are discharged and stacked onto the discharge tray.

3. The image forming apparatus according to claim 1, further comprising a detection unit configured to detect a cut mark recorded in a non-image region between the images, wherein the control unit controls the cutting unit to cut the continuous sheet at the leading end and the trailing end based on the cut mark detected by the detection unit.

4. The image forming apparatus according to claim 1, wherein the cutting unit includes a first cutter configured to cut the continuous sheet at the leading end and a second cutter configured to cut the continuous sheet at the trailing end.

5. The image forming apparatus according to claim 1, further comprising an inversion mechanism configured to invert the continuous sheet in a case where a two-sided printing is executed.

6. The image forming apparatus according to claim 5, wherein, in a case where the two-sided printing is executed, the control unit sends the continuous sheet to the inversion mechanism after images are formed on a first surface of the continuous sheet, and executes the first control and the second control after the continuous sheet is inverted and images are formed on a second surface of the continuous sheet.

7. The image forming apparatus according to claim 6, wherein, in a case where the two-sided printing is executed, the control unit controls the cutting unit to cut the continuous sheet while having the non-image region at the trailing end of the region in which the last image of the first surface of the continuous sheet is formed by the image forming unit.

8. The image forming apparatus according to claim 1, wherein the control unit executes the second control to put in a second printed product the first image of the image group, and executes the first control to put in a first printed product an image of the image group other than the first image, and wherein, in the second control, the control unit controls the cutting unit to cut the continuous sheet while having the non-image region at the leading end of the second region in which the first image of the image group is formed.

9. The image forming apparatus according to claim 1, wherein the control unit executes the second control to put in a second printed product a first image of the image group, and executes the first control to put in a first printed product an image of the image group other than the first image, and wherein, in the second control, the control unit controls the cutting unit to cut the continuous sheet while having the non-image region at the trailing end of the second region in which the first image of the image group is formed.

10. The image forming apparatus according to claim 1, wherein the control unit executes the second control to put in a second printed product a last image of the image group, and executes the first control to put in a first printed product an image of the image group other than the last image, and wherein, in the second control, the control unit controls the cutting unit to cut the continuous sheet while having the non-image region at the leading end of the second region the in which last image of the image group is formed.

11. The image forming apparatus according to claim 1, wherein the control unit executes the second control to put in a second printed product a last image of the image group, and executes the first control to put in a first printed product an image of the image group other than the last image, and wherein, in the second control, the control unit controls the cutting unit to cut the continuous sheet while having the non-image region at the trailing end of the second region in which the last image of the image group is formed.

12. The image forming apparatus according to claim 1, wherein the continuous sheet is a roll sheet.

13. The image forming apparatus according to claim 1, wherein an image formed by the image forming unit has a different length in a conveyance direction of the continuous sheet according to an image size.

14. The image forming apparatus according to claim 1, wherein the image forming unit includes a recording head provided with a nozzle capable of discharging ink across a full width of the continuous sheet to be used.

15. The image forming apparatus according to claim 1, further comprising an input unit configured to receive first information, wherein the image forming unit records second information in the non-image region based on the first information received by the input unit.

16. A creation method of a printed product comprising:

sequentially forming images of an image group including a plurality of images on a continuous sheet while providing a non-image region between the images;

creating a first printed product by cutting the continuous sheet at a leading end and a trailing end of a first region in which an image is formed;

discharging the first created printed product which includes the first region to a discharge tray;

creating a second printed product by cutting the continuous sheet while having a non-image region at at least any one of a leading end and a trailing end of a second region in which at least any one of a first image and a last image of the image group is formed; and discharging the second printed product which includes the second region and the non-image region to the discharge tray.

* * * * *